US008952800B2

(12) United States Patent
Bantz et al.

(10) Patent No.: US 8,952,800 B2
(45) Date of Patent: Feb. 10, 2015

(54) PREVENTION OF TEXTING WHILE OPERATING A MOTOR VEHICLE

(75) Inventors: David F. Bantz, Portland, MA (US); Thomas E. Chefalas, Somers, NY (US); Leslie S. Liu, White Plains, NY (US); Steven J. Mastrianni, Unionville, CT (US); James R. Moulic, Poughkeepsie, NY (US); Dennis G. Shea, Ridgefield, CT (US)

(73) Assignee: International Business Machines Corporation, Armonk, NY (US)

( * ) Notice: Subject to any disclaimer, the term of this patent is extended or adjusted under 35 U.S.C. 154(b) by 81 days.

(21) Appl. No.: 13/603,585

(22) Filed: Sep. 5, 2012

(65) Prior Publication Data

US 2012/0326855 A1 Dec. 27, 2012

Related U.S. Application Data

(63) Continuation of application No. 13/004,490, filed on Jan. 11, 2011.

(51) Int. Cl.
*B60Q 1/00* (2006.01)
*G07C 5/00* (2006.01)

(52) U.S. Cl.
CPC ..... *G07C 5/008* (2013.01)
USPC ..... 340/439; 340/438; 340/425.5

(58) Field of Classification Search
USPC ..... 340/439, 438, 425.5
See application file for complete search history.

(56) References Cited

U.S. PATENT DOCUMENTS

| | | | | |
|---|---|---|---|---|
| 5,081,667 | A | 1/1992 | Drori et al. | |
| 5,103,474 | A | 4/1992 | Stoodley et al. | |
| 6,232,874 | B1 | 5/2001 | Murphy | |
| 6,337,641 | B1 | 1/2002 | Yoshioka et al. | |
| 6,405,213 | B1 | 6/2002 | Layson et al. | |
| 6,529,723 | B1 | 3/2003 | Bentley | |
| 6,535,743 | B1 | 3/2003 | Kennedy, III et al. | |
| 6,603,405 | B2 | 8/2003 | Smith | |
| 6,625,539 | B1 | 9/2003 | Kittell et al. | |
| 6,674,362 | B2 | 1/2004 | Yoshioka et al. | |
| 6,690,302 | B1 | 2/2004 | Inomata | |
| 6,728,605 | B2 | 4/2004 | Lash et al. | |
| 6,826,460 | B2 | 11/2004 | Kittell et al. | |
| 6,847,889 | B2 | 1/2005 | Park et al. | |
| 7,023,332 | B2 | 4/2006 | Saito et al. | |
| 7,042,345 | B2 * | 5/2006 | Ellis | 340/436 |
| 7,221,928 | B2 | 5/2007 | Laird et al. | |
| 7,876,205 | B2 * | 1/2011 | Catten et al. | 340/439 |
| 8,098,132 | B2 | 1/2012 | Scalisi et al. | |

(Continued)

OTHER PUBLICATIONS

Office Action dated Jan. 2, 2014 for U.S. Appl. No. 13/602,866.

(Continued)

*Primary Examiner* — George Bugg
*Assistant Examiner* — Naomi Small
(74) *Attorney, Agent, or Firm* — Tutunjian & Bitetto, P.C.; Louis J. Percello

(57) ABSTRACT

A system and method includes sensors configured to measure conditions of a vehicle. A monitoring module is configured to evaluate the conditions input thereto from the sensors. The monitoring module is further configured to determine a state of a mobile device located within the vehicle. Based upon a combination of the conditions of the vehicle and the state of the mobile device, a determination of improper use of the mobile device is made.

20 Claims, 3 Drawing Sheets

(56) References Cited

U.S. PATENT DOCUMENTS

| | | | | |
|---|---|---|---|---|
| 8,290,480 | B2 * | 10/2012 | Abramson et al. | 455/418 |
| 2001/0040504 | A1 | 11/2001 | Gehlot | |
| 2001/0040506 | A1 | 11/2001 | Boulay et al. | |
| 2002/0044049 | A1 | 4/2002 | Saito et al. | |
| 2002/0161495 | A1 | 10/2002 | Yamaki | |
| 2002/0173881 | A1 | 11/2002 | Lash et al. | |
| 2002/0198660 | A1 | 12/2002 | Lutter et al. | |
| 2003/0009270 | A1 | 1/2003 | Breed | |
| 2003/0060968 | A1 | 3/2003 | MacPhail et al. | |
| 2003/0095038 | A1 | 5/2003 | Dix | |
| 2003/0096594 | A1 * | 5/2003 | Naboulsi | 455/411 |
| 2003/0128123 | A1 | 7/2003 | Sumiya et al. | |
| 2003/0212480 | A1 | 11/2003 | Lutter et al. | |
| 2005/0179518 | A1 | 8/2005 | Kawamura et al. | |
| 2005/0203698 | A1 | 9/2005 | Lee | |
| 2005/0222730 | A1 * | 10/2005 | Taipale | 701/41 |
| 2006/0020380 | A1 | 1/2006 | Saito et al. | |
| 2007/0135978 | A1 | 6/2007 | Kim et al. | |
| 2007/0156311 | A1 | 7/2007 | Elcock et al. | |
| 2008/0122595 | A1 | 5/2008 | Yamamichi et al. | |
| 2008/0133230 | A1 * | 6/2008 | Herforth | 704/235 |
| 2008/0238642 | A1 | 10/2008 | Mauti | |
| 2008/0258890 | A1 | 10/2008 | Follmer et al. | |
| 2008/0319602 | A1 | 12/2008 | McClellan et al. | |
| 2009/0085728 | A1 * | 4/2009 | Catten et al. | 340/425.5 |
| 2009/0096599 | A1 | 4/2009 | Kranz | |
| 2009/0109037 | A1 * | 4/2009 | Farmer | 340/576 |
| 2009/0256690 | A1 | 10/2009 | Golenski | |
| 2009/0312902 | A1 | 12/2009 | Miller et al. | |
| 2010/0097239 | A1 | 4/2010 | Campbell et al. | |
| 2010/0151838 | A1 | 6/2010 | Wormald et al. | |
| 2011/0140913 | A1 | 6/2011 | Montenero | |
| 2011/0267205 | A1 | 11/2011 | McClellan et al. | |
| 2011/0304446 | A1 * | 12/2011 | Basson et al. | 340/438 |
| 2012/0075118 | A1 | 3/2012 | Basir | |
| 2012/0098750 | A1 * | 4/2012 | Allen et al. | 345/169 |
| 2012/0244883 | A1 | 9/2012 | Tibbitts et al. | |

OTHER PUBLICATIONS

Office Action mailed on Aug. 19, 2012 for U.S. Appl. No. 13/004,462.

Final Office Action mailed on Dec. 18, 2012 for U.S. Appl. No. 13/004,462.

Office Action mailed on Nov. 19, 2013 for U.S. Appl. No. 13/004,462.

Office Action mailed on Nov. 16, 2012 for U.S. Appl. No. 13/602,866.

Final Office Action mailed on Jun. 18, 2013 for U.S. Appl. No. 13/602,866.

* cited by examiner

PREVENTION OF TEXTING WHILE OPERATING A MOTOR VEHICLE

RELATED APPLICATION INFORMATION

This application is a Continuation application of co-pending U.S. patent application Ser. No. 13/004,490 filed on Jan. 11, 2011, incorporated herein by reference in its entirety.

This application is related to commonly assigned application: "MOBILE COMPUTING DEVICE EMERGENCY WARNING SYSTEM AND METHOD", Ser. No. 13/004,462, filed on Jan. 11, 2011 and incorporated herein by reference.

BACKGROUND

1. Technical Field

The present invention relates to vehicle safety, and more particularly to systems and methods for preventing unsafe use of a communication device while operating a vehicle.

2. Description of the Related Art

Distracted drivers cause a large number of automobile accidents, and according to the national traffic safety administration (NTSA), distracted drivers are 23 times more likely to be in an accident while texting or while otherwise being distracted. Current solutions to this problem include publicizing the danger of texting while driving. This solution has proven ineffective.

SUMMARY

A system and method includes sensors configured to measure conditions of a vehicle. A monitoring module is configured to evaluate the conditions input thereto from the sensors. The monitoring module is further configured to determine a state of a mobile device located within the vehicle. Based upon a combination of the conditions of the vehicle and the state of the mobile device, a determination of improper use of the mobile device is made.

A system includes an on-board vehicle computer system configured to monitor one or more sensors which measure one or more conditions of a vehicle. The computer system includes a monitor module configured to evaluate the one or more conditions input thereto from the one or more sensors and determine a state of a mobile device located within the vehicle wherein based upon a combination of the one or more conditions of the vehicle and the state of the mobile device a determination of improper use of the mobile device is made. A notification device is associated with the mobile device to notify one or more entities via an external network that the improper use has been detected.

A method includes storing one or more condition criteria in a memory device; monitoring one or more conditions in a vehicle; monitoring usage of a mobile device in the vehicle; responsive to the usage and the one or more conditions, determining whether improper use of the mobile device has been performed; and communicating the improper use to one or more of the vehicle, individuals in the vehicle and an entity via an external network.

These and other features and advantages will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein.

DETAILED DESCRIPTION OF PREFERRED EMBODIMENTS

Figure 1:
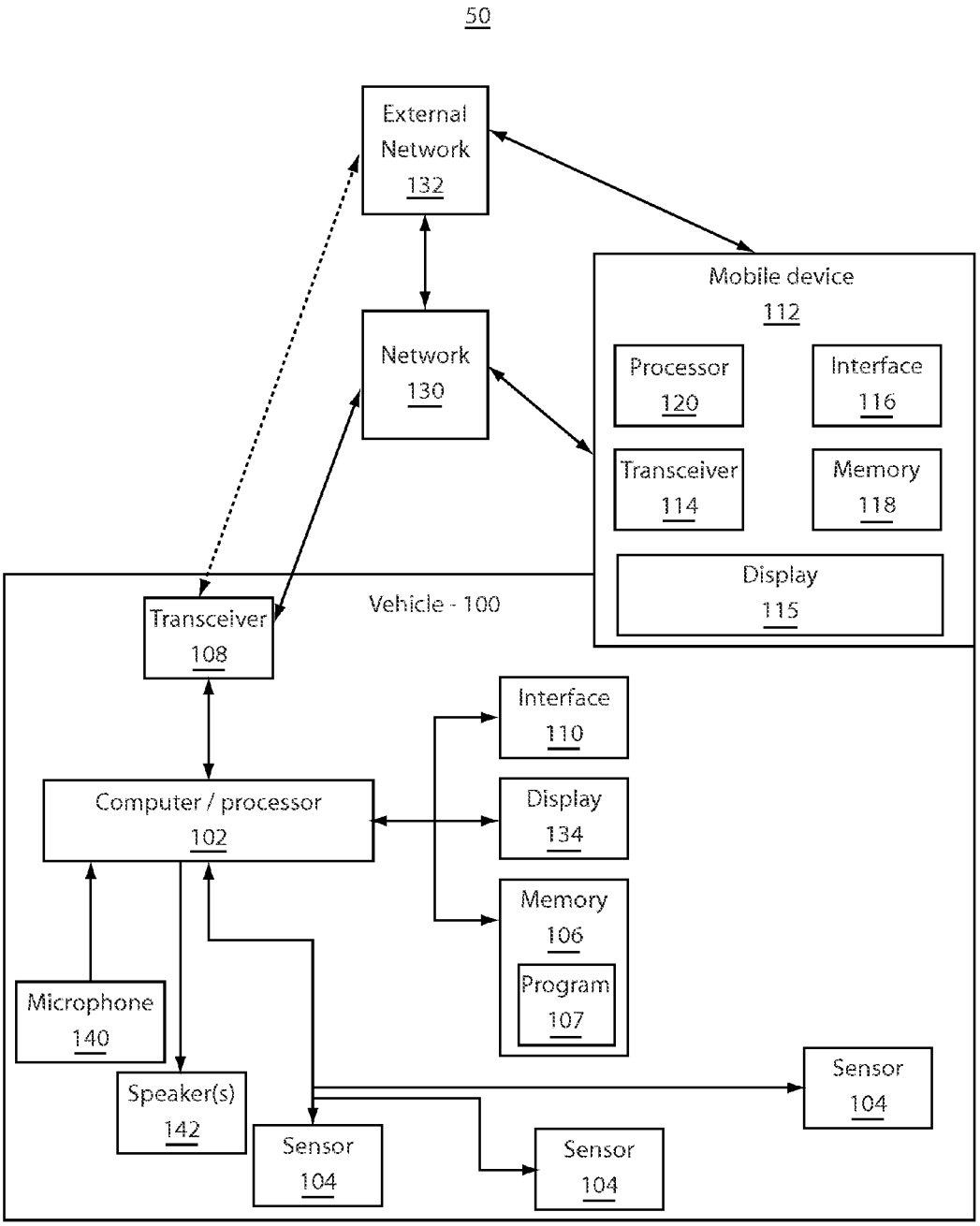
FIG. 1 is a block/flow diagram showing an illustrative distraction determination and prevention system for motor vehicles in accordance with one exemplary embodiment.

In accordance with the present principles, systems and methods are provided to address issues with respect to distracted driving. In one embodiment, a system/method leverages and correlates inputs of a plurality of sensors in a passenger cab and/or drive train of a vehicle. For example, these sensors may include a seat belt sensor, an air bag sensor, a steering linkage sensor, brakes and wheels sensors, a throttle sensor, etc. The system analyzes operations to determine whether a driver is being distracted, e.g., by using texting features on their phone while operating a motor vehicle, falling asleep at the wheel, or otherwise not paying attention or prudently driving.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Referring now to the drawings in which like numerals represent the same or similar elements and initially to FIG. 1, an illustrative embodiment of a mobile computing device warning system 50 is shown in accordance with the present principles. The system 50 includes a vehicle 100, such as, an automobile, truck, boat, ship, train, plane, tram, etc. The vehicle 100 includes a computer 102 or computing device. Computer 102 may be a standard on-board computer device but may be configured using appropriate hardware and/or software to interact with and communicate with other devices via a network 130. The computer 102 includes memory 106 for storing policies, user defined event criteria, software for computer 102, software for monitoring sensors 104, software and storage for other functions and applications.

Sensors 104 may include sensors to determine information obtained from the vehicle, such as hard braking, radar detection, collision sensors, accelerometers, etc. Sensors 104 may include sensors to determine if an emergency exists or that there is an impending emergency situation. Sensors 104 may include sensors that monitor a condition of a human within the vehicle, e.g., pace makers, a drivers position (slumped or sleeping, etc.).

The computer 102 of the vehicle 100 is linked with a local telecommunication device 112, such as a cell phone, netbook, laptop, etc. via the local network 130. The local network may be established upon activating the telecommunication device during the operation of the vehicle 100. A link may use technology similar to Blue Tooth™ enabled devices, wireless local area network devices, home network technology or the like. The computer 102 may include a transceiver 108 configured to communicate with a transceiver of the telecommunication device 112 or directly with an external network 132. The telecommunication device 112 preferably includes a processor 120, memory 118, an interface 116, a display 115 and a transceiver 114.

The sensors 104 may include a seat belt sensor, an air bag sensor, a steering linkage sensor, brakes and wheels sensors, a throttle sensor, etc. Any number of sensors may be employed and configured to report to the computer 102 of the vehicle 100. The computer 102 includes a program 107 which analyzes operations to determine whether a driver is being distracted, e.g., texting, falling asleep at the wheel, not paying attention, etc. Program 107 checks readings or measurements from each of the sensors 104 and analyzes the readings to look for specific combinations of parameters to determine a particular condition. For example, a combination of sensor readings may be indicative of a driver being impaired, such as erratic steering feedback, erratic braking feedback, etc. The computer 102 may be configured to collect sensor data for a particular user/driver. A baseline may be created for that user. The system 50 learns by observing the actions of the driver. This may include a profile associated with a driver over a period of time. The profile may be stored in memory 106, 118 or stored at a service provider. In one embodiment, the profile is stored in an ignition key pellet and is accessed when the key is inserted in the ignition of the vehicle 100. Thus, the learned profile of a particular driver can be linked to the key or other device they use (e.g., mobile device). The system 50 includes the ability to monitor and learn the behavior of the driver and then make a determination of what constitutes "abrupt changes to this data" or a triggering event.

Over time abrupt changes to this data may be indicative of a problem or other distraction. The computer 102 analyzes the data to determine an appropriate action and may be equipped to alert the driver or any other entities on a notification list via text message, email, telephone call, etc. using the telecommunication device 112 to interface with the external network 132. The external network 132 may include a telephone network, a cable network, a satellite network or the like.

In one embodiment, the computer 102 may be configured to communicate with a user in the vehicle 100 to permit the user to select text messages to be played on the vehicle's audio system. The text messages may be responded to verbally as well using a speech to text converter. In this instance, a microphone 140 and one or more speakers 142 may be employed. Messages could be prioritized or filtered (e.g., in accordance with policies) based on the context or situation using sensor feedback in the computer 102. Incoming phone or text messages may be displayed on the vehicle's video display 134.

In another embodiment, the manner in which a user enters data into a device keyboard, e.g., interface 116, may be profiled and employed to determine if the user is distracted while using the keyboard. For example, if the user tries to text while driving, the user would likely be entering data in a sporadic fashion because the user would have to keep looking up at the road. Program 107 uses information obtained from computer 102 and sensors 104 to determine if the user is distracted or otherwise improperly operating the vehicle. E.g., if the user were stationary, it is likely that their keyboard entry would be more uniform. The erratic behavior could be correlated with the vehicle's seat detection to determine that the driver is the one performing the erratic data entry, correlated with the speedometer or engine speed sensor, etc. Other types of sensing may be employed to detect, e.g., active cell phones in the vehicle 100, such as Blue Tooth™ technology or other proximity sensing technology, to then identify which passenger is the driver and apply the keyboard stroke profiling/monitoring. In one embodiment, sensing an active cell phone in the driver's physical position in the vehicle may include mounting multiple directionally sensitive antenna/receiver sensors (104) in the passenger compartment and evaluating RF signal phase and amplitude information to obtain a coarse idea of the physical location of active cell phones in the vehicle.

Periodically monitoring RF traffic and/or the device interface 116 (e.g., keyboard) could accurately detect who the active driver is and whether the driver is using their telephone. The computer 102 and the device 112 may work together to ensure that texting/emailing/Internet surfing is not being performed by the driver. The device 112 can report usage to the computer 102, and the computer 102 can identify a position of the user and driving feedback information to the device 112. Using the two, a decision may be made as to whether improper use of one of the device 112 and the vehicle 100 is being performed. In addition, corrective action may be taken. The corrective actions may include an audible alarm in the vehicle, an automatic message to a boss, parent or other person, a shut down of the device 112, etc. For example, parents could be notified if their children are texting while driving or performing any unsafe actions that might result in an accident, etc. The device 112 (e.g., phone) could send the parents a text message informing them.

Similar applications may be provided for non-drivers as well. For example, non-drivers that are also distracted may also have transmissions blocked. In one embodiment, a non-driver, due to their position may be permitted to provide a gesture with the device (gesture recognition may be employed) or provide a key sequence/sentence to type to ensure one is not distracted. The non-drivers which may have their position known (using, e.g., a seat sensor or RF sensors) may have their communications initiated or re-initiated upon performing the gesture or properly typing the sequence, etc.

In one embodiment, a correlation program (program 107 or a program resident in memory 118 of device 112) may be employed to correlate a pattern of keystrokes in a sequence with movements of the steering wheel (from a sensor 104). A user is considered to be a driver if their keystroking is momentarily interrupted by the need to correct the steering of the car. This correlation can be performed by having the device 112 interact with the computer 102 so that movement of the steering wheel can be detected. Similar correlations may be made which may include braking and operations of other vehicle controls (e.g., radio, HVAC, etc.). It should be understood that the functions described for the vehicle computer 102 may be shared with or carried out by the mobile device 112 as well.

In another embodiment, the mobile device 112 may be configured to automatically determine whether a user of the device 112 is also the operator of a piece of equipment, such as a motor vehicle, bus, train, table saw, etc. The mobile device 112, e.g., may sense engine noise, equipment operation or the like during usage of the device 112. The device 112 may be programmed to enforce local laws or policy for how a mobile device 112 is to be used. The laws or policy can be based on location of the device 112 (e.g., using global positioning or cellular location technology). The location is then correlated to the local laws and compared to determine violations. The local laws may also be based on policy or rules/laws established by the vehicle owner or other user. The mobile device 112 can use one or more methods to determine if the user is the operator of a piece of equipment. For example, decibel levels can be measured (e.g., operating a power tool, flying a plane, etc.) or sensors may be supplied and mounted on equipment as needed. These sensors (104) may work in conjunction with a vehicle computer (102) or may work directly with the mobile device 112.

Figure 2:
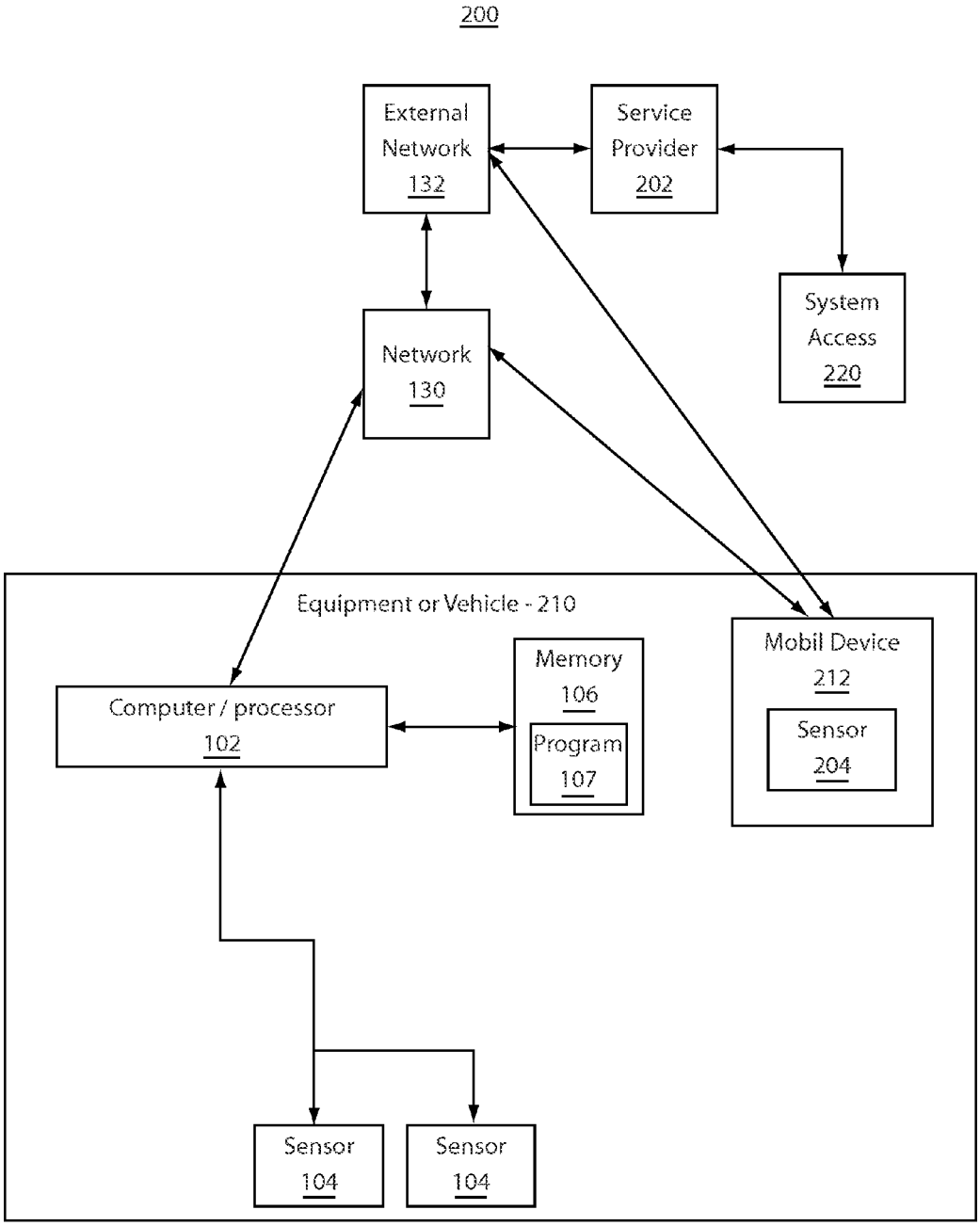
FIG. 2 is a block/flow diagram showing another illustrative system for distraction determination and prevention in motor vehicles in accordance with another exemplary embodiment.

Referring to FIG. 2, an illustrative system/method 200 is shown where a service provider 202 plays an active role to prevent text-and-drive. In one embodiment, the use of text messaging or other distracting computing device use is detected. The service provider 202 can monitor a wireless device 212 (e.g., a phone) by comparing a frequency of the device 212 changing in a fast moving vehicle 210 relative to a base-station, e.g., the Doppler effect.

In another embodiment, the service provider 202 can disable text messaging under appropriate circumstances. For example, if the service provider 202 detects a phone 212 is in a fast moving vehicle 210, the in-coming texting service is temporarily postponed and a text message is sent to the user together with a text string once the vehicle 210 has come to a stop. The message can be read, e.g., as: "Your incoming text message is temporarily stored in our server because you were detected in a car, if you want to enable texting, please reply to this message with the following key: W#RWXcccE13."

While the vehicle 210 is moving, incoming text messages will be stored and delivered later when the user is no longer in the moving vehicle. The user can disable this hold any time by sending a message with the enabling key. This can greatly reduce text-and-drive actions by automatically disabling the incoming text messages that could "distract" the driver (and in many cases, prompt them to reply).

In a particularly useful embodiment, the policy or directive to prevent texting or other distractive behavior may be pushed onto the mobile device 112 from the external network 132. A web site or service provider 202 may be employed to restrict usage under the measured conditions resulting from a parental restriction, an insurance company mandate, corporate policy, etc. The restriction may be based on the driver's age, driving record driving restrictions, etc. A parent can log onto a web site from an access system 220 (e.g., a computer, cell phone, etc.) and initiate a phone usage restriction for a child's telephone. The website would then push the limitation onto the mobile device using feedback from the computer 102 (e.g., moving vehicle, etc.) to determine if the conditions are met for the parental defined restriction.

Figure 3:
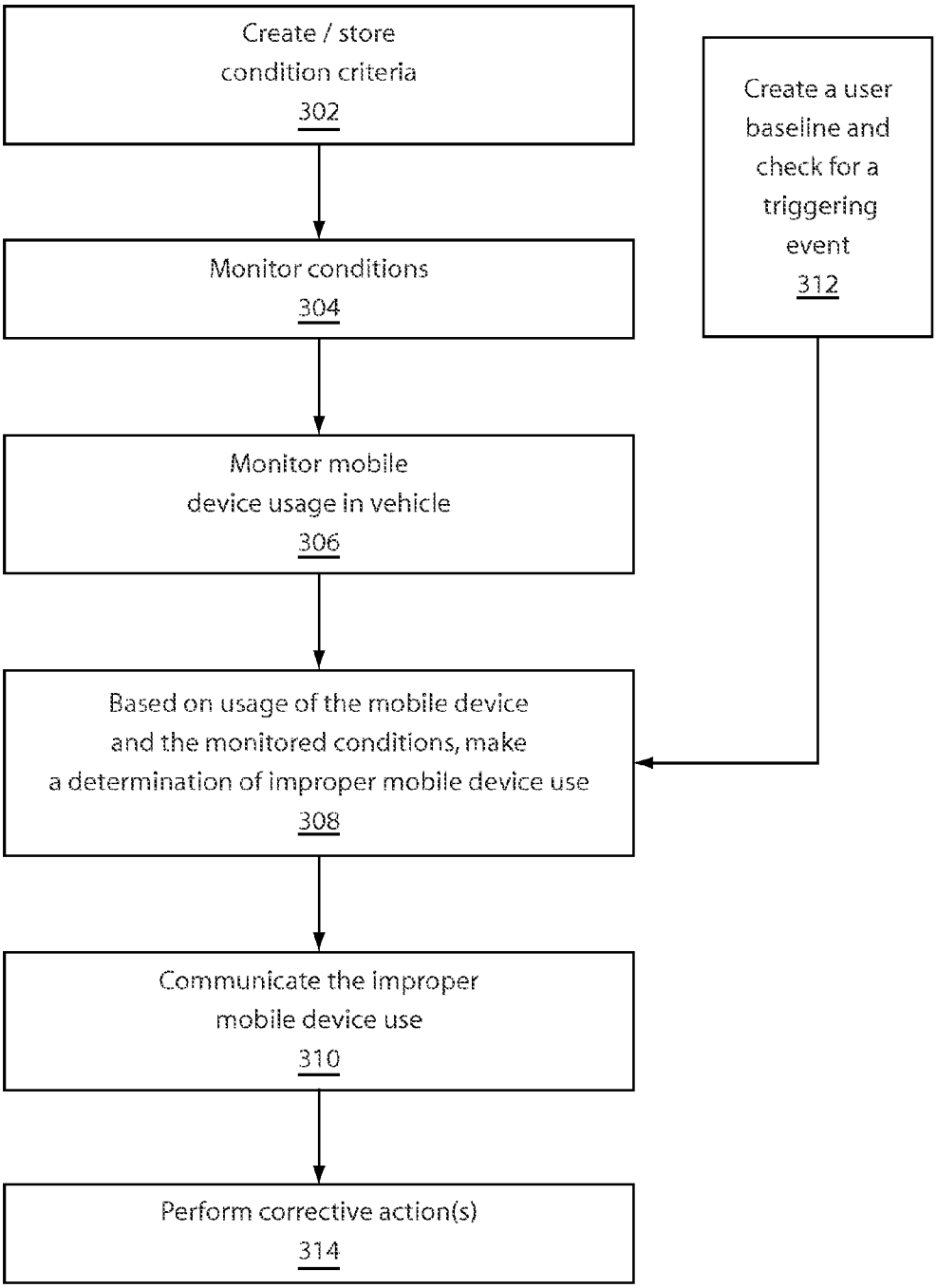
FIG. 3 is a block/flow diagram showing an illustrative system/method for distraction prevention while operating a motor vehicle in accordance with another exemplary embodiment.

Referring to FIG. 3, a system/method is illustratively shown for warning of and/or limiting use of a mobile device in a vehicle, especially while driving. In block 302, one or more condition criteria are created and/or stored in a memory device. The condition criteria may be user set, may include a default setup or may be based on government laws or policies provided by a service provider. Combinations of these conditions will be employed to determine that the use of a mobile device is improper. In block 304, one or more conditions in a vehicle are monitored. This may include monitoring one or more sensors that measure, e.g., the motion of the vehicle, determine if a person in the driver's seat is the one that is using the mobile device and if there is concurrent use of a driving mechanism (e.g., steering wheel, seat, pedals, etc.) and the mobile device (e.g., a cell phone, etc.).

In block 306, usage of a mobile device in the vehicle is monitored. This may include determining whether data is being entered, transmissions are being sent or received, etc. In block 308, responsive to the usage and the one or more conditions, a determination of whether improper use of the mobile device has been performed is made. For example, if the steering wheel is being operated in a moving vehicle and the keypad of the mobile device is being used by a person in the driver's seat, there is an improper use of the mobile device. In block 310, the improper use may be communicated to one or more of the vehicle (e.g., the on-board computer system), individuals in the vehicle (e.g., a warning sound) and an entity via an external network (e.g., text a parent or employer). The mode of communication may include texting a message, emailing a message, a telephoning a message to notify the one or more entities, etc.

In one embodiment, information about a particular user may be collected to determine baseline driving data for that user and provide a warning if a triggering change occurs, in block 312. A triggering change may include a reading over a set threshold, a combination of readings, etc. so that a determination of improper use (e.g., texting or emailing while driving, etc.) may be made. The improper use may be determined by one of a sporadic fashion of entering data by a user and/or based on a correlation between feedback of driving activities and times of inputs to the mobile device by a user.

In block 314, a corrective action may be performed when the improper use is detected. The corrective action may include one or more of: an audible alarm in the vehicle, an automatic message sent over an external network; a shut down of the mobile device or a function thereof, etc.

Having described preferred embodiments for prevention of texting while operating a motor vehicle (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A system, comprising:

one or more sensors configured to measure one or more conditions of a vehicle; and a monitoring module configured to evaluate the conditions input thereto from the one or more sensors, the monitoring module further configured to determine a state of a phone located within the vehicle, wherein the monitoring module collects information about a user to determine baseline driving data for that user and create a learned profile for that user, wherein the learned profile is linked to the phone;

wherein based upon a combination of the one or more conditions of the vehicle and the state of the phone, a determination of improper use of the phone is made, wherein the improper use is determined by profiling a manner in which a user enters data into the phone.

2. The system as recited in claim 1, wherein the one or more sensors are configured to measure at least one of motion of a vehicle, a position of a driver of the vehicle and concurrent use of a driving mechanism and the phone.

3. The system as recited in claim 1, wherein the phone includes a wireless communication device that communicates with an external network to notify an entity of the improper use.

4. The system as recited in claim 1, wherein the monitoring module provides a warning if a triggering change from the data of the learned profile occurs.

5. The system as recited in claim 1, wherein the vehicle includes a computer system and the phone and the computer system communicate such that messages received by the phone are rendered acoustically and are responded to verbally.

6. The system as recited in claim 1, wherein the improper use is determined by a sporadic fashion of entering data by a user.

7. The system as recited in claim 1, wherein the improper use is determined based on a correlation between feedback of driving activities and times of inputs to the phone by a user.

8. The system as recited in claim 1, wherein the monitoring module initiates a corrective action when the improper use is detected.

9. The system as recited in claim 8, wherein the corrective action includes one or more of: an audible alarm in the vehicle, an automatic message sent over an external network; a shut down of the phone or a function thereof.

10. A system, comprising:

an on-board vehicle computer system configured to monitor one or more sensors which measure one or more conditions of a vehicle;

the computer system including a monitoring module configured to evaluate the one or more conditions input thereto from the one or more sensors and determine a state of a phone located within the vehicle, wherein based upon a combination of the one or more conditions of the vehicle and the state of the phone a determination of improper use of the phone is made, wherein the improper use is determined by profiling a manner in which a user enters data into the phone, wherein the monitoring module collects information about a user to determine baseline driving data for that user and create a learned profile for that user, wherein the learned profile is linked to the phone, and wherein the phone is further programmed to enforce laws for how to use the phone, said laws being based on at least a location of the phone, and wherein the location is correlated to the laws to determine improper use of the phone; and a notification device associated with the phone to notify one or more entities via an external network that the improper use has been detected.

11. The system as recited in claim 10, wherein the one or more sensors are configured to measure at least one of motion of a vehicle, a position of a driver of the vehicle and concurrent use of a driving mechanism and the phone.

12. The system as recited in claim 10, wherein the notification device includes at least one of a text message application, and email application and a telephone application to notify the one or more entities.

13. The system as recited in claim 10, wherein the monitoring module provides a warning if a triggering change from the data of the learned profile occurs.

14. The system as recited in claim 10, wherein the computer system renders messages received by the phone acoustically and the messages are responded to verbally.

15. The system as recited in claim 10, wherein the improper use is determined by a sporadic fashion of entering data by a user.

16. The system as recited in claim 10, wherein the improper use is determined based on a correlation between feedback of driving activities and times of inputs to the phone by a user.

17. The system as recited in claim 10, wherein one of the monitoring module and the phone initiates a corrective action when the improper use is detected wherein the corrective action includes one or more of: an audible alarm in the vehicle, an automatic message sent over an external network; and a shut down of the phone or a function thereof.

18. A non-transitory computer readable storage medium comprising a computer readable program, wherein the computer readable program when executed on a computer causes the computer to perform the steps of:

storing one or more condition criteria in a memory device;

monitoring one or more conditions in a vehicle;

monitoring usage of a phone in the vehicle;

responsive to the usage and the one or more conditions, determining whether improper use of the phone has been performed, wherein the improper use is determined by profiling a manner in which a user enters data into the phone, further comprising collecting information about a user to determine baseline driving data for that user and create a learned profile for that user, and linking the learned profile to the phone; and communicating the improper use to one or more of the vehicle, individuals in the vehicle and an entity via an external network.

19. The non-transitory computer readable storage medium as recited in claim 18, wherein the phone enables communicating with the external network.

20. The non-transitory computer readable storage medium as recited in claim 18, wherein the step of communicating comprises providing a warning if a triggering change from the data of the learned profile occurs.

* * * * *